US007044430B2

(12) United States Patent
Brugman et al.

(10) Patent No.: US 7,044,430 B2
(45) Date of Patent: May 16, 2006

(54) LOCK BARS FOR BLOWOUT PREVENTER

(75) Inventors: James D. Brugman, Spring, TX (US); Frank Benjamin Springett, Houston, TX (US); Dean Allen Bennett, Katy, TX (US)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 10/974,012

(22) Filed: Oct. 26, 2004

(65) Prior Publication Data

US 2005/0242309 A1 Nov. 3, 2005

Related U.S. Application Data

(62) Division of application No. 10/836,819, filed on Apr. 30, 2004.

(51) Int. Cl.
*F16K 51/00* (2006.01)
*E21B 33/06* (2006.01)

(52) U.S. Cl. ..... 251/1.1; 137/383; 277/325

(58) Field of Classification Search ..... 251/1.3, 251/1.1; 277/324, 325; 137/383, 384, 385, 137/315.41

See application file for complete search history.

(56) References Cited

U.S. PATENT DOCUMENTS

| | | | | |
|---|---|---|---|---|
| 2,194,257 | A * | 3/1940 | Allen | 251/356 |
| 4,039,003 | A * | 8/1977 | Cheek | 137/516.29 |
| 4,253,638 | A | 3/1981 | Troxell, Jr. | 251/1 A |
| 4,502,534 | A | 3/1985 | Roche et al. | 166/84 |
| 4,519,577 | A | 5/1985 | Jones | 251/62 |
| 4,558,842 | A | 12/1985 | Peil et al. | 251/1.3 |
| 4,582,293 | A | 4/1986 | Jones | 251/1.3 |
| 4,827,974 | A * | 5/1989 | Coulter | 251/61.1 |
| 5,199,683 | A | 4/1993 | Le | 251/1.3 |
| 5,400,857 | A | 3/1995 | Whitby et al. | 166/297 |
| 5,505,426 | A | 4/1996 | Whitby et al. | 251/1.3 |
| 5,575,452 | A | 11/1996 | Whitby et al. | 251/1.3 |
| 5,588,491 | A | 12/1996 | Brugman et al. | 166/383 |
| 5,662,171 | A | 9/1997 | Brugman et al. | 166/383 |
| 5,735,502 | A | 4/1998 | Levett et al. | 251/1.3 |
| 5,897,094 | A | 4/1999 | Brugman et al. | 251/1.3 |
| 5,975,484 | A | 11/1999 | Brugman et al. | 251/1.3 |
| 6,244,560 | B1 | 6/2001 | Johnson | 251/1.3 |
| 6,360,770 | B1 * | 3/2002 | Buchner et al. | 137/315.12 |
| 6,374,925 | B1 | 4/2002 | Elkins et al. | 175/25 |
| 6,510,897 | B1 | 1/2003 | Hemphill | 166/373 |

(Continued)

OTHER PUBLICATIONS

PCT/GB 2005/050018: Annex to Form PCT/ISA/206: 4pp.: mailed Apr. 27, 2005.

*Primary Examiner*—John Bastianelli
(74) *Attorney, Agent, or Firm*—Guy McClung

(57) ABSTRACT

Lock bars for blowout preventers and blowout preventers having, in certain aspects, a body with a top, a bottom, and a bore therethrough, at least one bonnet releasably secured to the body, a first lock bar recess defined by a first portion in the body and a second portion in the bonnet, at least one lock bar removably disposed in the lock bar recess for releasably connecting the at least one bonnet to the body, the at least one lock bar having a body with a first end and a second tapered end and/or with an end opening in an end of the at least one lock bar.

9 Claims, 4 Drawing Sheets

U.S. PATENT DOCUMENTS

| | | | | |
|---|---|---|---|---|
| 6,554,247 | B1 | 4/2003 | Berckenhoff et al. | 251/1.3 |
| 2003/0085040 | A1 | 5/2003 | Hemphill et al. | 166/377 |
| 2004/0021102 | A1 | 2/2004 | Berckenhoff et al. | 251/1.1 |
| 2004/0021269 | A1 | 2/2004 | Gaudette et al. | 277/325 |
| 2004/0084644 | A1 | 5/2004 | Wiedemann | 251/1.3 |
| 2004/0222393 | A1 | 11/2004 | Kinder | 251/1.3 |

* cited by examiner

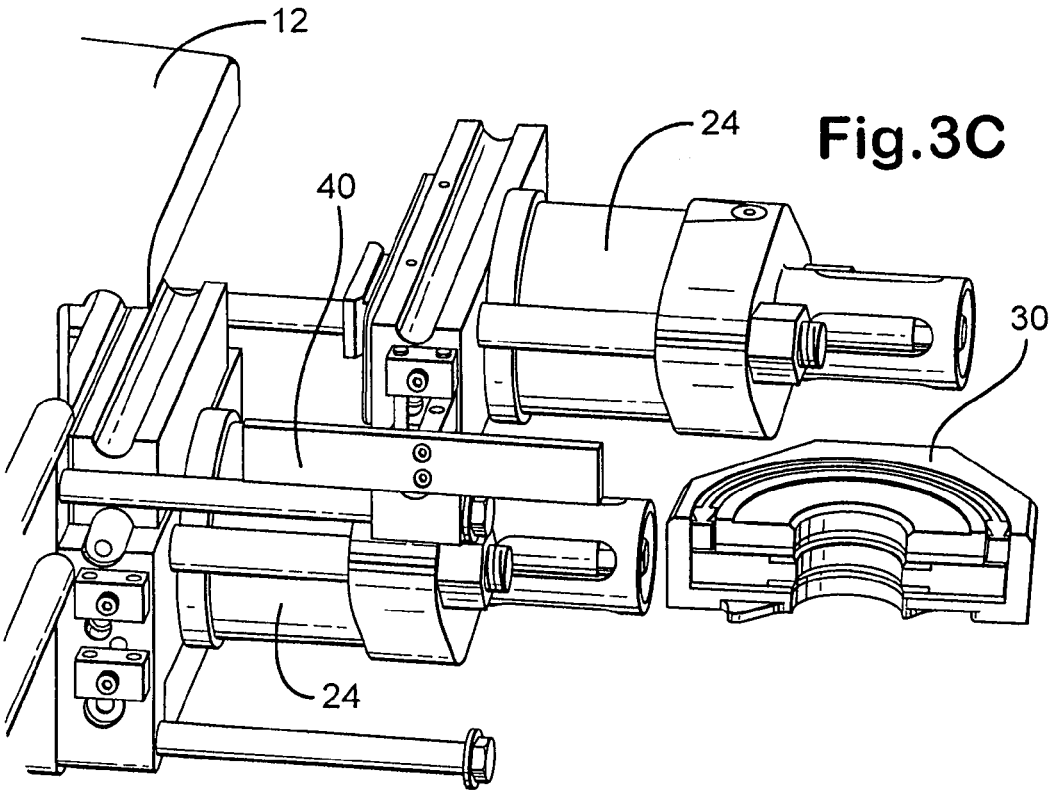
Fig.3C
Fig.4
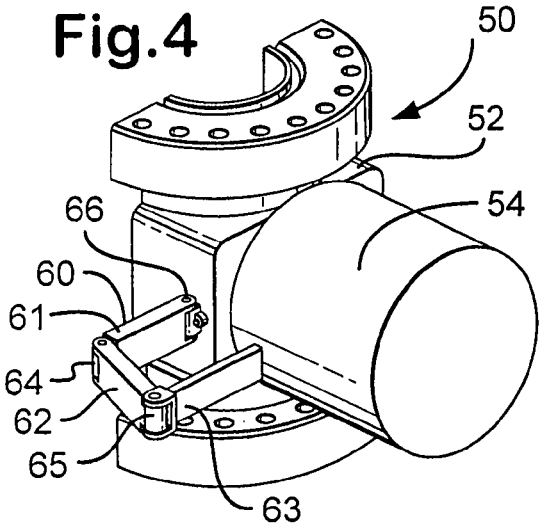
Fig.5A
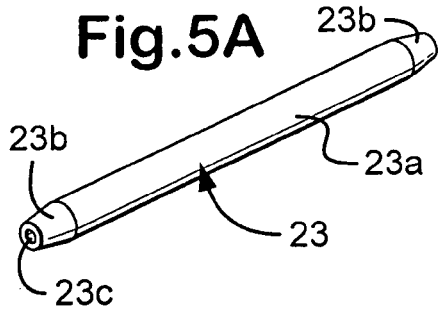
Fig.5B
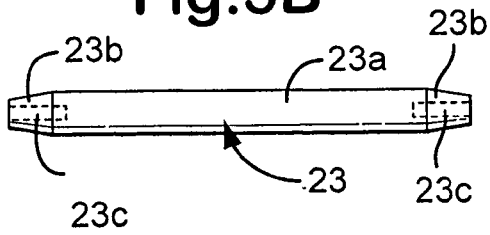
Fig.5C
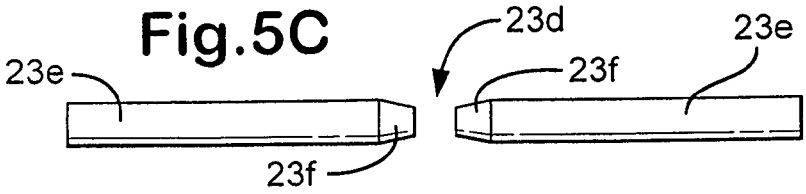

LOCK BARS FOR BLOWOUT PREVENTER

CROSS REFERENCE TO RELATED APPLICATIONS

This is a division of U.S. application Ser. No. 10/836,819 filed Apr. 30, 2004, fully incoroporated herein for all purposes.

BACKGROUND OF THE INVENTION

1. Field of the Invention

This present invention is directed to blowout preventers, to bonnets and ram blocks for them, and, in certain particular aspects, to pivotal ram block supports, and methods of their use.

2. Description of Related Art

The prior art discloses a wide variety of blowout preventers and blowout preventer bonnets.

Typical blowout preventers have selectively actuatable rams in oppositely disposed bonnets secured to the body which, in certain prior art systems, are movably secured with movable bars or with hinges and bolts so that the bonnet is movable for access and maintenance. The rams are either pipe rams (to contact, engage, and encompass pipe and/or tools to seal a wellbore) or shear rams (to contact and physically shear a pipe or tool in a wellbore). Rams are usually positioned opposite each other on either side of a main body and can seal against each other at a center of the main body over a center of a wellbore.

Typical rams include a ram block on which parts, e.g. seals and/or cutting blades, are releasably secured. Such seals can be subject to high pressures and to chemical reaction with drilling fluids which can damage the seals. Often rams are inspected or changed out. Prior art systems include a variety of movable bonnets for accessing rams and seals. Blowout preventers are disclosed in many U.S. patents, including, but not limited to, U.S. Pat. Nos. 3,946,806; 4,043,389; 4,313,496; 4,132,267, 4,558,842; 4,969,390; 4,492,359; 4,504,037; 2,752,119; 3,272,222; 3,744,749; 4,253,638; 4,523,639; 5,025,708; 5,056,418; 5,400,857; 5,575,452; 5,655,745; and 5,918,851.

There has long been a need, recognized by the present inventors for a blowout preventer with easy access to a ram block in a bonnet and for easily moving such a ram block to a position at which it can be inspected and/or replaced.

There has long been a need, recognized by the present inventor for easy access to sets of rams (lower and/or upper) of a blowout preventer.

BRIEF SUMMARY OF THE INVENTION

In one aspect, the present invention discloses a blowout preventer with a movable ram block support connected to a side of a blowout preventer. In one aspect, the present invention discloses a blowout preventer with a body with a top, a bottom, and a bore therethrough from the top to the bottom; ram apparatus movable within the body, the ram apparatus including a ram block; and ram block holding apparatus pivotably secured exteriorly to the body, e.g., to a main body of the blowout preventer or to a door or bonnet, the ram block holding apparatus pivotable for selectively engaging and supporting the ram block and moving the ram block with respect to the body.

In one aspect a blowout preventer according to the present invention has a ram block holder pivotably connected to an exterior (to a bonnet or to a part of a main body of a blowout preventer) and positioned so that part of it can be moved to be received in a recess or groove of a ram block. Once the ram block is secured on the ram holder, by pivoting the ram block holder, the ram block can be moved away from the main body and from a corresponding bonnet that initially contains the ram block.

In certain aspects the ram block holder is movable toward the ram block and into a supporting position with respect to the ram block. The ram block can remain on the ram block holder for inspection and/or maintenance or it can disconnected therefrom for inspection and/or replacement. In one aspect the ram block support apparatus according to the present invention has an arm that, in one position, is selectively alignable with a general direction of a bonnet and/or a ram actuator apparatus.

In certain aspects a blowout preventer according to the present invention has one block holding/manipulation apparatus which can be selectively positioned with respect to any bonnet and/or any block and then secured in place for operation; or, also according to the present invention, a blowout preventer can be provided with two or more such apparatuses.

In one aspect, a block support according to the present invention has a plurality of pivotably connected parts providing an articulable support that is easily movable to a deployed position.

It is, therefore, an object of at least certain embodiments of the present invention to provide new, useful, unique, efficient, nonobvious blowout preventers and methods of their use, lock bars with end tapers and/or with end openings for manipulation for releasably holding a bonnet, and movable ram block holding apparatus for blowout preventers;

Such ram block holding apparatus that is positionable on a blowout preventer main body, door or bonnet;

Such a blowout preventer with one, two, or more ram block holding apparatuses;

Such a blowout preventer and ram block support apparatus in which a support has multiple pivotal parts and the support is articulable; and Such a blowout preventer with manually emplaceable and removable bonnet lock bars.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later disguise it by variations in form, changes, or additions of further improvements.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 3A–3C are perspective views which show the operation of ram block manipulation apparatus of a blowout preventer of FIG. 1.

FIG. 4 is a perspective view of a blowout preventer with an articulable ram block support according to the present invention.

FIG. 5A is a perspective view of a lock bar according to the present invention. FIG. 5B is a side view in cross-section of FIG. 5A. FIG. 5C is a side view of a lock bar pair according to the present invention.

DETAILED DESCRIPTION OF THE INVENTION

Figure 1A:
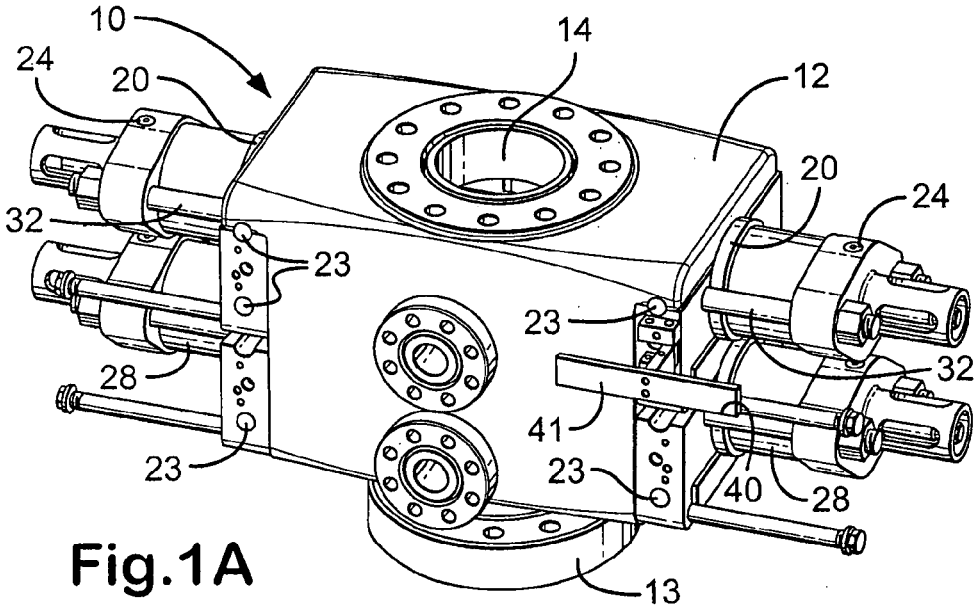
FIG. 1A is a perspective view of a blowout preventer according to the present invention.
Figure 1B:
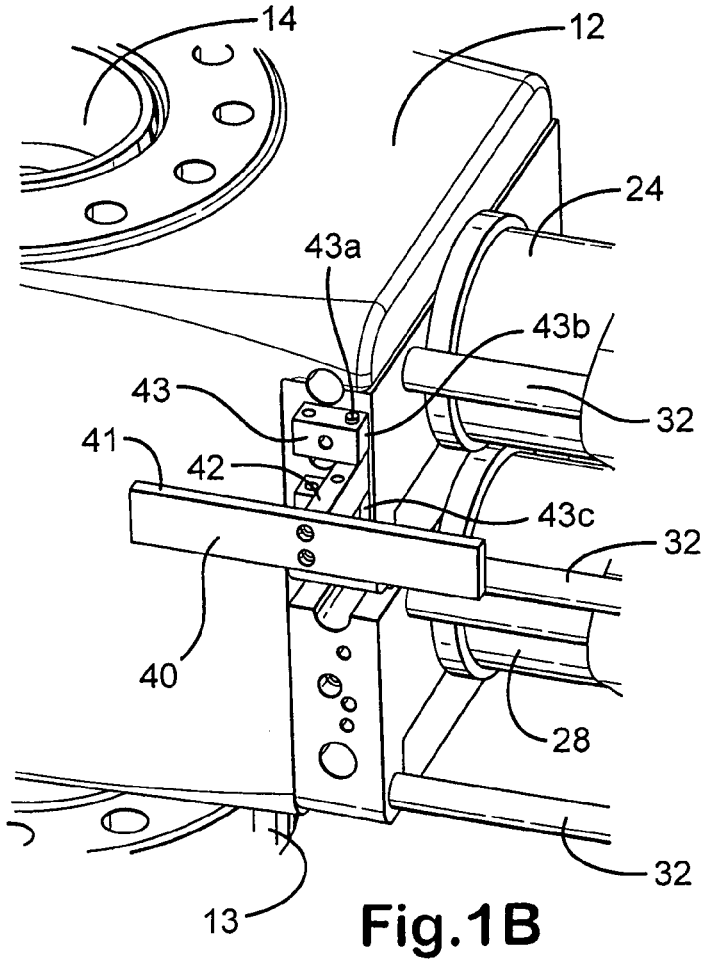
FIG. 1B is an enlargement of part of the blowout preventer of FIG. 1A.
Figure 1C:
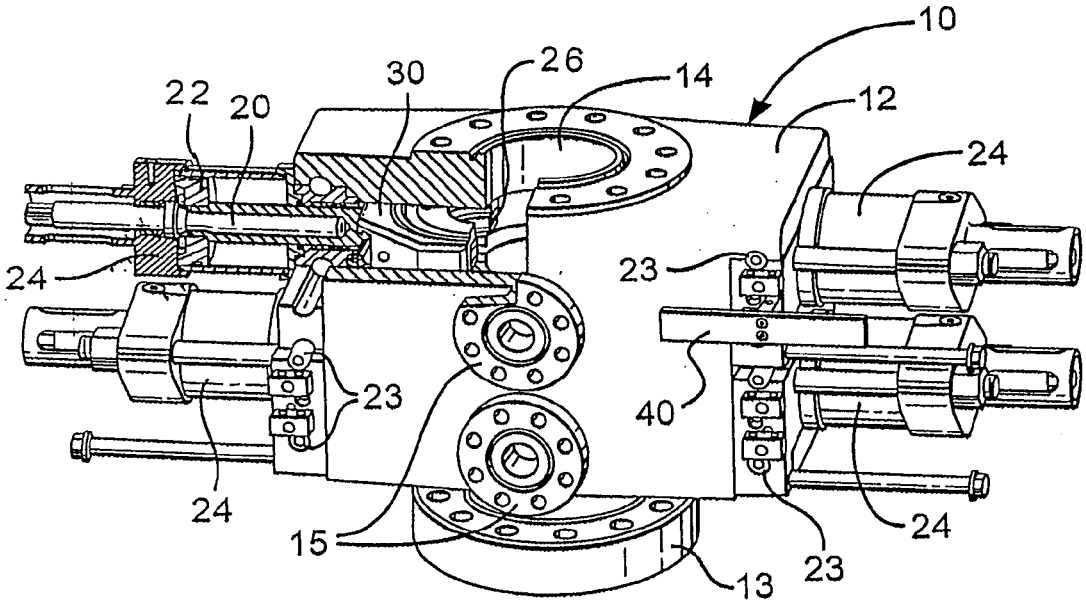
FIG. 1C is a partially cut-away view of the blowout preventer of FIG. 1A.

As shown in FIGS. 1A–1C a blowout preventer 10 according to the present invention has a main body 12 with a bore 14 therethrough from top to bottom, side outlets 15, and a lower flange 13 for releasably connecting the blowout preventer 10 to other apparatus, e.g. in a wellhead installation.

The blowout preventer 10 has opposed ram apparatuses 20 each with its respective actuator apparatus 22 within a bonnet 24. Each ram apparatus 20 includes a typical ram block 30 with seals 26. Below the bonnets 24 are dual opposed bonnets 28 each housing rams (not shown) and associated actuator apparatuses.

Figure 2:
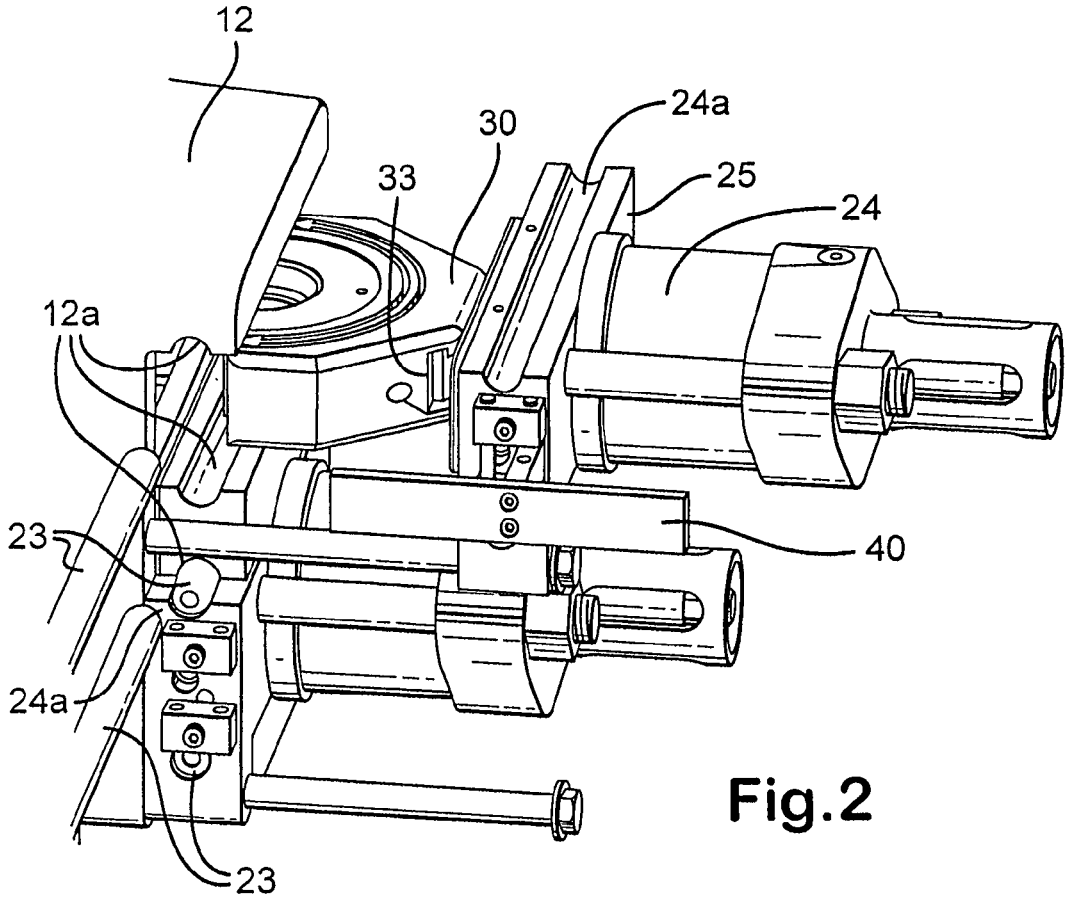
FIG. 2 is a perspective view of part of the blowout preventer of FIG. 1.

It is within the scope of the present invention for the bonnets 24 to be movably connected to the main body 12 in any manner with any structure known in the prior art. As shown in FIGS. 1 and 2 the bonnets are releasably connected to the main body 12 with removable bars 23, according to the present invention, and the bonnets 24 are movably mounted on shafts 32 which project out from the main body 12 (as are the bonnets 28). Each movable bar 23 resides in a channel formed by corresponding recesses 24*a* in the bonnet block 25 and 12*a* in aa body 12. The bars 23 are manually removable.

Pivotably connected to a side of a bonnet 24 is a block holder 40 according to the present invention which includes a main bar 42 and an arm 41. The main bar 42 is pivotably connected with a pin 43*a* to a mount 43 which is secured to the bonnet 24 with bolts 44. The mount 43 has upper and lower parts 43*b*, 43*c*. As shown in FIG. 1C the arm 41 is aligned with or generally parallel to a side of the body 12 and the bonnet 24.

Figure 3A:
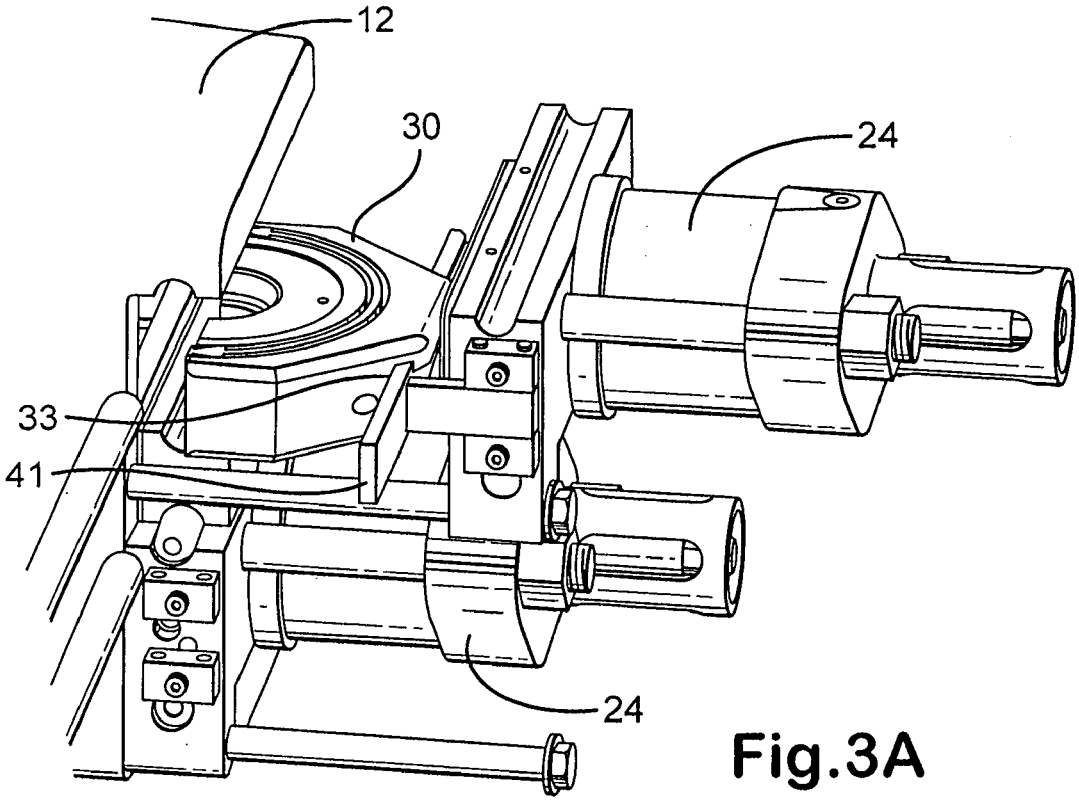
Figure 3B:
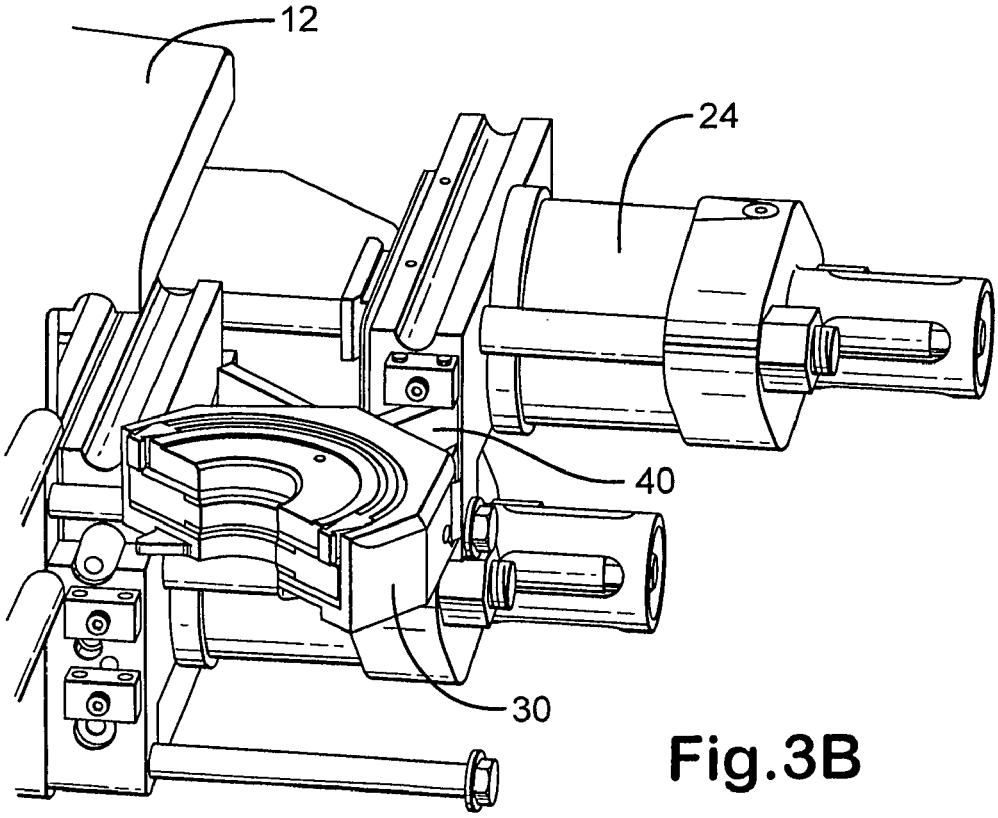

As shown in FIG. 3A, the block holder 40 has been pivoted and the arm 41 has been aligned with a recess 33 of the ram block 30. FIG. 3B illustrates movement of the ram block 30 away from the main body 12 as the block holder 40 is pivoted away from the main body 12. At this point seals or other parts of the ram block 30 can be inspected and/or replaced. In certain aspects the recess 33 is a typical T-bar slot already present in the ram block. In other aspects, an appropriate recess is made in the ram block.

As shown in FIG. 3C the ram block 30 has been disengaged from the block holder 40 and the block holder 40 is in position to receive a new ram block or to have the ram block 30, once inspected and/or serviced, replaced thereon for reinstallation in the bonnet 24.

According to the present invention a ram holder may be on either side of a blowout preventer.

As shown in FIG. 2, the recess 33 is "T" shaped.

It is within the scope of the present invention for the recess 33 to have any suitable cross-sectional shape, including but not limited to, "L" shaped, inverted "L" shaped, "T" shaped, inverted "T" shaped, or "C" shaped; and for a ram block to have one, two, or more of such recesses with multiple recesses spaced-apart from each other.

It is within the scope of the present invention to provide multiple types of blowout preventers with block holding/manipulation apparatus according to the present invention; including, but not limited to, blowout preventers with shear rams, blind rams, shear blind rams, pipe rams, and multi-rams (double, triple sets).

FIG. 4 shows a blowout preventer 50 (partially) according to the present invention, like the blowout preventer 10, FIG. 1A, but with a ram block support apparatus 60 connected to a main body 52 instead of to a bonnet 54. It is within the scope of the present invention for an apparatus according to the present invention, like apparatus 60, to be connected to a bonnet or for an apparatus according to the present invention, like the apparatus 40, to be connected to a main blowout preventer body.

The apparatus 60 has three bars 61, 62, 63 with the bars 61 and 62 pivotably connected together with a pivotal connection 64 and the bars 62 and 63 pivotably connected together with a pivotal connection 65. The bar 61 is pivotably connected to the body 52 with a pivotal connection 66. The bar 63 serves as does the arm 41 in the apparatus 40 and is sized and configured for receipt within a slot or recess in a ram block when the bonnet 54 is moved away from the body 52.

FIGS. 5A and 5B show one of the removable bars (or "lock bars") 23 of FIG. 2. The bar 23 has a body 23*a*, optional tapered ends 23*b*, and an optional inner opening 23*c* which may be threaded for mating with a tool to facilitate installation of and removal of the lock bar or it may have a shape such as a hex shape for receiving a tool end.

FIG. 5C shows another embodiment 23*d* of a pair of lock bars 23*e*, each of which is emplaceable in and removal from one of two spaced-apart sides of a bonnet or door. Optionally, the bars 23*e* may have an opening like the opening 23*c*, FIG. 5B, and/or two tapered ends like the ends 23*b*. As shown each lock bar 23*e* has one tapered end 23*f*.

The present invention, therefore, provides in some, but not in necessarily all, embodiments a blowout preventer with a body with a top, a bottom, and a bore therethrough from the top to the bottom, ram apparatus movable within the body, the ram apparatus including a ram block, and ram block holding apparatus pivotably secured exteriorly to the body, the ram block holding apparatus pivotable for selectively engaging and supporting the ram block and moving the ram block with respect to the body.

Such a blowout preventer may have one or some, in any possible combination, of the following: the body including at least one bonnet movably secured to the body, the at least one bonnet containing actuator apparatus for moving the ram block, and the ram block holding apparatus pivotably and releasably secured to the at least one bonnet; wherein the ram block has a corresponding opening and the ram block holding apparatus includes a mount connected to the body, a main bar pivotably connected to the mount, an arm secured to or formed integrally with the mount, the arm at an angle to the main body, and the arm sized and configured for receipt within the corresponding opening of the ram block; wherein the movable ram apparatus has part thereof in a ram actuator housing projecting from the main body and wherein the ram block holding apparatus has a main support body, the ram block holding apparatus positionable so that the ram block holding apparatus main support body is substantially aligned with the ram actuator housing; wherein the ram block holding apparatus is manually movable; at least one lock bar, and in one aspect two lock bars, removably disposed in a lock bar recess, the lock bar recess defined by a first portion in the body and a second portion in the bonnet; wherein the at least one bonnet includes a first bonnet on a first side of the main body and a second bonnet on a second side of the main body, the first bonnet opposed to the second bonnet, a first ram block adjacent the first bonnet, and the ram block holding apparatus movably secured exteriorly to the second bonnet for selectively engaging and supporting a second ram block adjacent the second bonnet; wherein the ram block holding apparatus is selectively movable from its securement exteriorly to the second bonnet and is securable exteriorly to the first bonnet for holding the first ram block; wherein the blowout preventer has bonnet movement apparatus connected thereto for the moving the at least one bonnet away from the body; wherein the bonnet movement apparatus includes shaft apparatus projecting from the body, the at least one bonnet movable on the shaft apparatus; and/or wherein the movable ram apparatus is shear ram apparatus.

The present invention, therefore, provides in at least some embodiments, methods for using a ram block support and a blowout preventer according to the present invention.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to the step literally and/or to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112. The inventors may rely on the Doctrine of Equivalents to determine and assess the scope of their invention and of the claims that follow as they may pertain to apparatus not materially departing from, but outside of, the literal scope of the invention as set forth in the following claims. All patents and applications identified herein are incorporated fully herein for all purposes.

What is claimed is:

1. A blowout preventer comprising a body with a top, a bottom, and a bore therethrough from the top to the bottom, at least one bonnet releasably secured to the body, a first lock bar recess defined by a first portion in the body and by a second portion in the bonnet, at least one lock bar removably disposed in the first lock bar recess for releasably connecting the at least one bonnet to the body, the at least one lock bar comprising a first lock bar with a lock bar body with a first end and a second tapered end for facilitating installation of the at least one lock bar in the lock bar recess and removal of the at least one lock bar from the first lock bar recess, ram apparatus movable within the body, the ram apparatus including a ram block, ram block holding apparatus pivotably secured exteriorly to the body, the ram block holding apparatus pivotable for selectively engaging and supporting the ram block and moving the ram block with respect to the body, the at least one bonnet containing actuator apparatus for moving the ram block, the ram block holding apparatus pivotably and releasably secured to the at least one bonnet, wherein the ram block has a corresponding opening and the ram block holding apparatus includes a mount connected to the body, a main bar pivotably connected to the mount, an arm secured to or formed integrally with the mount, the arm at an angle to the main body, and the arm sized and configured for receipt within the corresponding opening of the ram block.

2. The blowout preventer of claim 1 wherein the first end is a first tapered end for facilitating installation of the at least one lock bar into and removal of the at least one lock bar from the first lock bar recess.

3. The blowout preventer of claim 1 wherein the second tapered end has an end opening to facilitate installation of and removal of the at least one lock bar from the first lock bar recess.

4. The blowout preventer of claim 2 wherein the first tapered end has a first end opening to facilitate installation of and removal of the at least one lock bar from the first lock bar recess.

5. The blowout preventer of claim 3 wherein the end opening is threaded.

6. The blowout preventer of claim 3 wherein the end opening is hex shaped for receiving a tool end.

7. The blowout preventer of claim 4 wherein the first end opening is hex shaped for receiving a tool end.

8. The blowout preventer of claim 1 wherein the at least one bonnet includes a first bonnet on a first side of the main body and a second bonnet on a second side of the main body, the first bonnet opposed to the second bonnet, a first ram block adjacent the first bonnet, and the ram block holding apparatus movably secured exteriorly to the second bonnet for selectively engaging and supporting a second ram block adjacent the second bonnet.

9. A blowout preventer comprising a body with a top, a bottom, and a bore therethrough from the top to the bottom, at least one bonnet releasably secured to the body, a first lock bar recess defined by a first portion in the body and a second portion in the bonnet, at least one lock bar removably disposed in the first lock bar recess for releasably connecting the at least one bonnet to the body, the at least one lock bar comprising a first lock bar with a solid generally cylindrical lock bar body with a first end and a second end, the second end having a second end opening for facilitating manual installation of the at least one lock bar in the lock bar recess and manual removal of the at least one lock bar from the first lock bar recess, wherein the first end is a first tapered end for facilitating installation and removal of the at least one lock bar.

* * * * *